United States Patent [19]

Hadachek

[11] Patent Number: 5,025,935

[45] Date of Patent: Jun. 25, 1991

[54] PORTABLE UPRIGHT SCUBA CYLINDER RETENTION RACK

[76] Inventor: Josh L. Hadachek, 635 46th Ave. Ct., Greeley, Colo. 80634

[21] Appl. No.: 506,460

[22] Filed: Apr. 9, 1990

[51] Int. Cl.[5] ..... A47F 7/00

[52] U.S. Cl. ..... 211/71; 211/13

[58] Field of Search ..... 211/71, 75, 87, 89, 211/103, 13, 60.1, 207, 195; 248/200.1

[56] References Cited

U.S. PATENT DOCUMENTS

| | | | |
|---|---|---|---|
| 1,936,517 | 11/1933 | Maine | 211/75 X |
| 2,051,420 | 8/1936 | Renholdt | 211/71 X |
| 2,278,232 | 3/1942 | Anderson | 211/71 X |
| 2,463,664 | 3/1949 | Watson | 211/75 X |
| 3,603,550 | 9/1971 | Byrd | 211/71 X |
| 3,689,016 | 9/1972 | Hammon | 211/71 X |
| 3,780,972 | 12/1973 | Brodersen | 211/71 X |

*Primary Examiner*—Sarah A. Lechok

[57] ABSTRACT

A scuba cylinder retention rack designed to be portable and keep the cylinders in an upright position during storage or when transported. The rack was designed for use in the bed of a pickup where a permanent mounting edge already exists, but can be used anywhere a similar edge or fixture is found or installed.

The vertical tube from the headpiece fits inside the vertical tube of the base and meets the spring that is housed in the base tube. When the headpiece is forced downward, the spring is compressed and the unit can be placed under the edge of the pickup bed or similar fixture. As the downward pressure on the headpiece is released, the unit expands and the edge holder on the rear of the headpiece contacts the mounting fixture. The expansion force of the spring keeps the unit securely in place. The cylinders can then be positioned in the unit and secured with a rubber strap.

Due to its ease of portability and vertical orientation, the one unit can be used for both permanent storage and transportation of cylinders, or can be removed when not in use.

3 Claims, 3 Drawing Sheets

PORTABLE UPRIGHT SCUBA CYLINDER RETENTION RACK

FIELD OF THE INVENTION

This invention relates to scuba diving and in particular a device for the transportation and storage of scuba cylinders.

RIGHTS TO INVENTIONS MADE UNDER FEDERALLY-SPONSORED RESEARCH AND DEVELOPMENT

None.

BACKGROUND OF INVENTION

The preferred method of storing or transporting a scuba cylinder is in the vertical position. Previously, mechanisms designed for securing scuba cylinders during transportation or storage involved placing the cylinder in a horizontal position on a type of block to prevent its rolling about, or in a permanently mounted vertical rack. The horizontal position is not suitable for long term storage of a cylinder due to corrosion, and requires much needed floor space during transportation. The vertical position provides better protection for the cylinder, easier access, and takes up less floor space, however, a permanently secured rack can become obtrusive when not in use, and is not easily moved to another place where it may be useful.

SUMMARY

This invention allows the scuba cylinders to be transported or permanently stored in the vertical position, reducing cylinder corrosion, vulnerability, and also taking up less space. The rack is very easily moved out of the way or to another place where it may be needed, such as from a pickup to a boat or the home. This is accomplished simply by pushing down on the top of it, thus compressing the spring, and allowing the entire unit to be removed without the need for tools.

OPERATION

Figure 1:
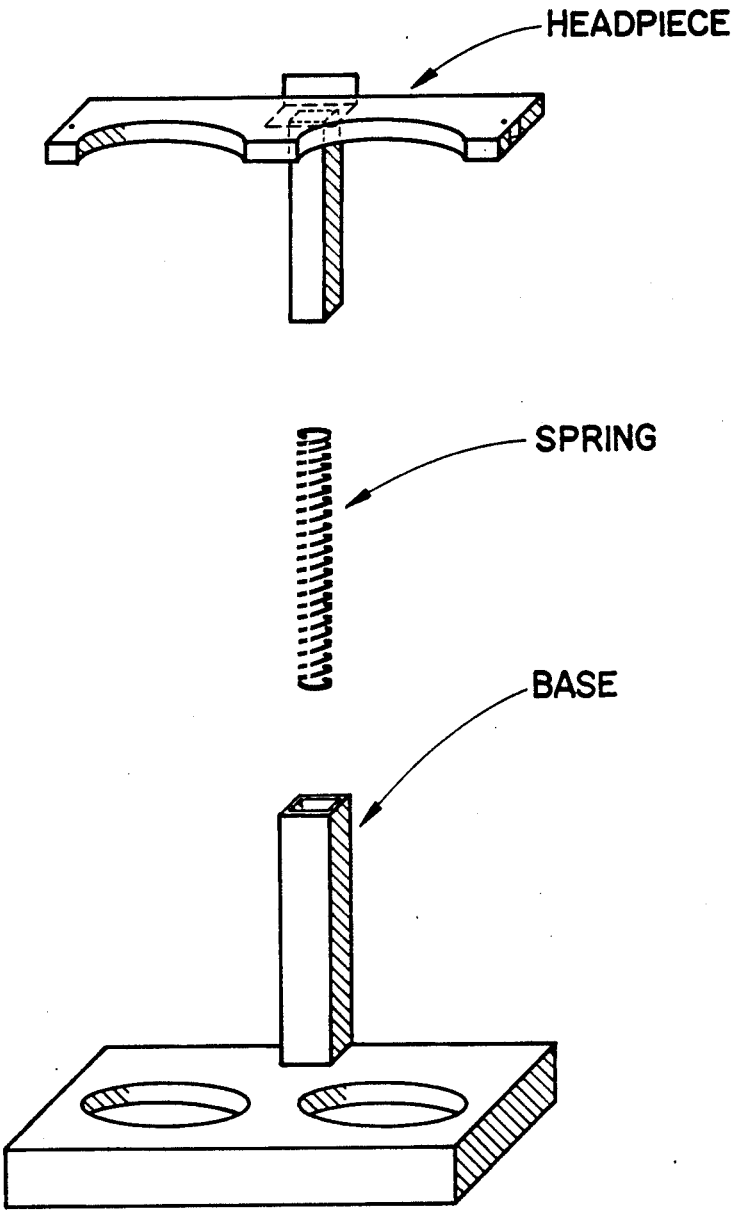
FIG. 1 is a perspective drawing of the separated components of the invention. These components are the Base, Spring, and the Headpiece. The Base consists of a hollow vertical tube open at the top end and connected at the bottom to a relatively shallow box structure with holes large enough to accept the bottom of a cylinder. The Headpiece consists of a vertical tube, either solid or closed at the ends, connected perpendicular to a flattened structure which has concave crescent shaped depressions on the forward side, and an edge holder on the back side. The Spring is the intermediate piece and fits inside the tube of the Base.
Figure 2:
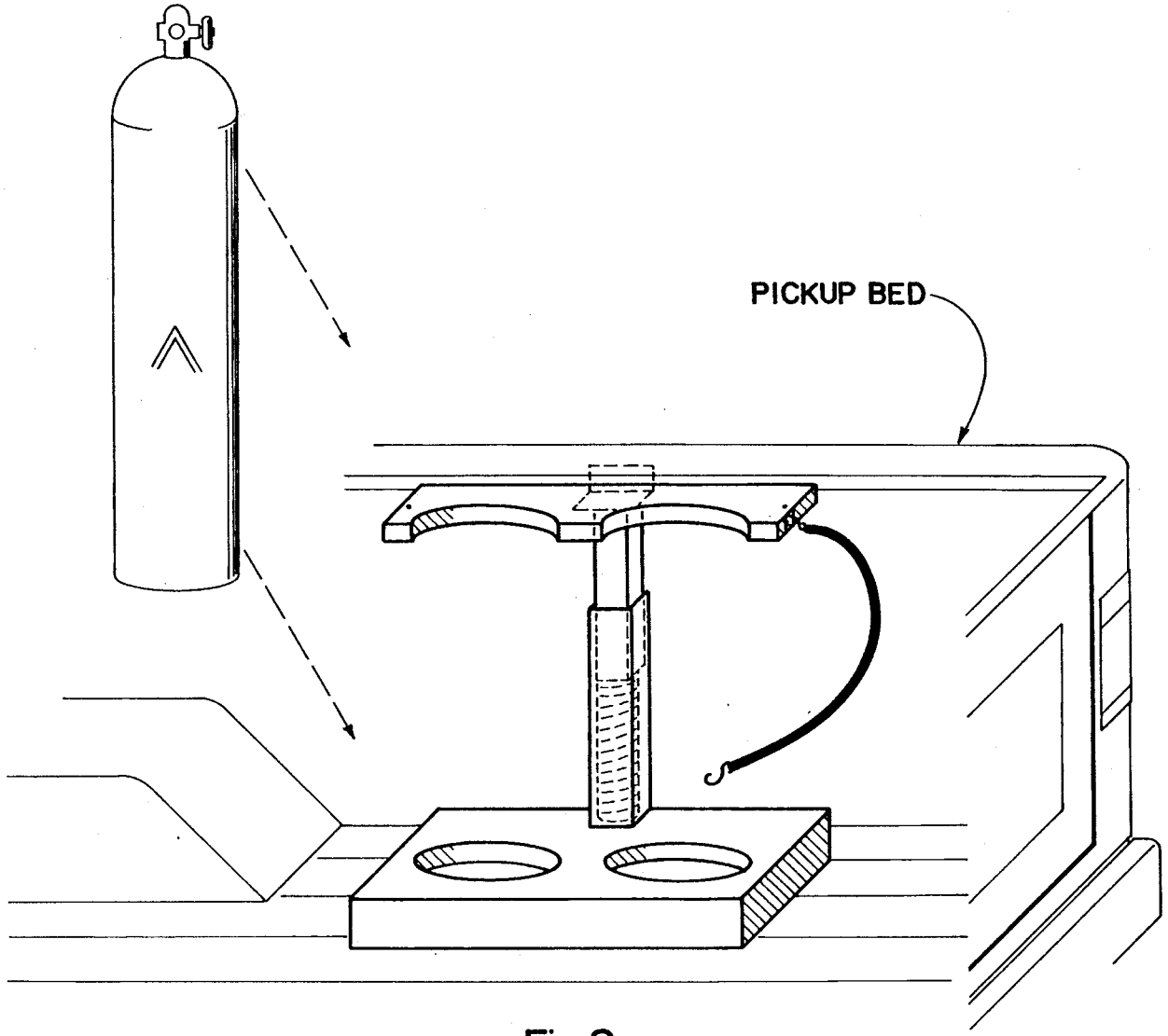
FIG. 2 is a perspective drawing that shows the invention in use in the bed of a pickup.
Figure 4:
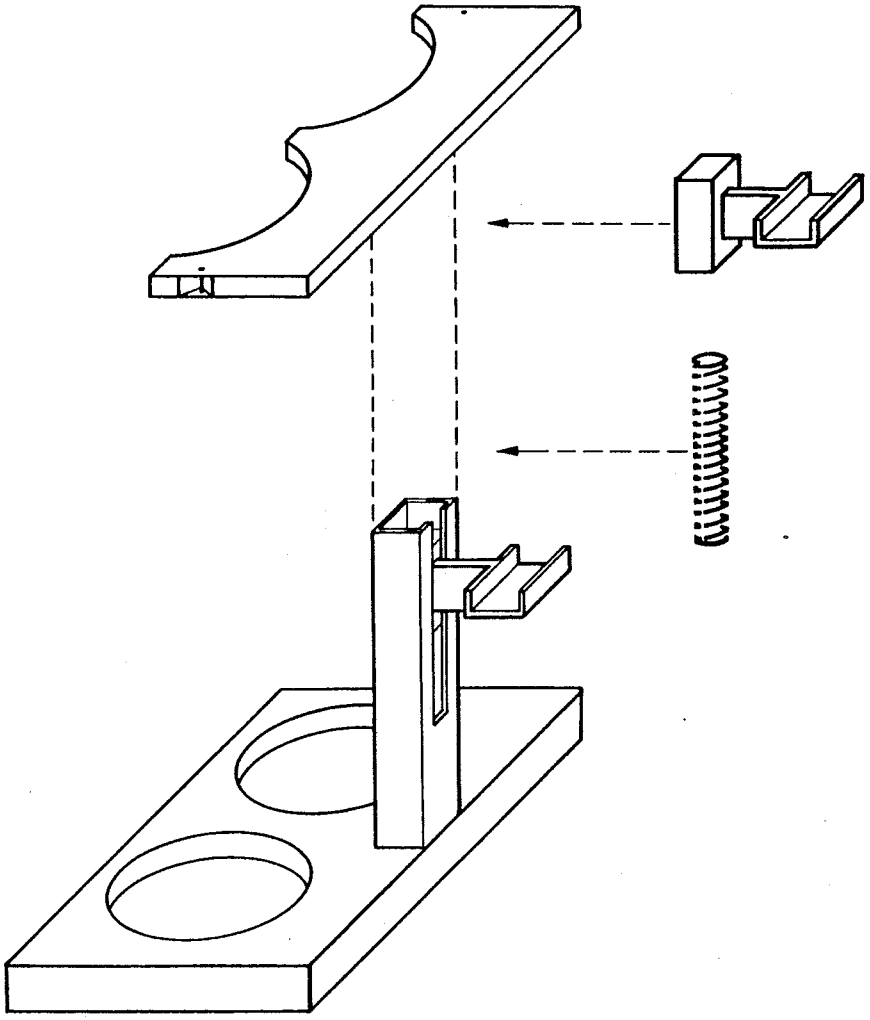
FIG. 4 is a perspective drawing that illustrates another possible method of operation with a slight variation of components. It utilizes one continuous tube attached to the Base that contains a spring and slider type edge holder.
Figure 3:
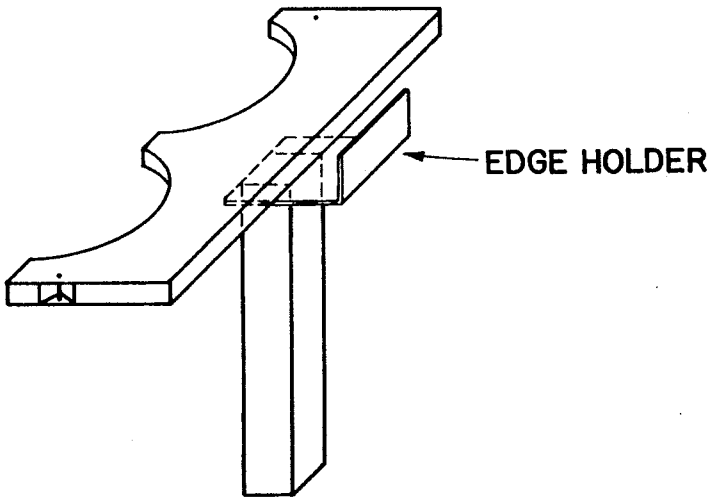
FIG. 3 is a rear view perspective drawing of the headpiece and features the edge holder.

The Base should be placed in the desired setup location, such as in the bed of a pickup or a boat etc., near where a permanent mounting edge exists, with the Base upright and the attached tube at the rear of the unit. The Spring provides the necessary expanding action and should be placed in the vertical tube of the Base. Position the vertical tube of the Headpiece in the tube of the Base so that the concave surfaces of the Headpiece are facing forward and align vertically with the rear of the holes in the Base. Press down on the Headpiece which will compress the Spring and force the upper tube inside the lower one. Slide the entire unit back and line up edge holder on the rear of Headpiece with the permanent edge of vehicle or other mounting fixture. Release downward pressure on the Spring so unit expands and catches the edge holder on the permanent edge. Now the scuba cylinder(s) can be placed upright into the unit so that the bottom of the cylinder is trapped by the hole in the Base, and the midsection of the cylinder is cradled by the concave surfaces of the Headpiece. A rubber strap is then connected to either side of the Headpiece, thus securing the cylinder(s). The above description is specific to one preferred embodiment of this invention and as FIG. 4 illustrates, there are other variations possible, such as only being capable of handling one cylinder at a time, or a simple channel cut into the Headpiece instead of having an edge holder, or even changing the expansion mechanism from a spring to hydraulic pressure, or a screw method. Different materials such as plastic, aluminum or steel may also be incorporated into different parts. Therefore, the scope of the invention should not be determined solely by the embodiment illustrated, but by the appended claims and their legal equivalents.

I claim:

1. A portable upright retention rack for use in the transporting and storage of compressed gas cylinders, without the use of tools, said cylinders having a bottom and upper portion, and said rack comprising:

a. a base piece capable of retaining the bottom of said cylinders, b. a top piece capable of retaining said cylinders upper portion and providing attachment to a permanent structure, c. a compressible component extending between and connecting said base piece and said top piece.

2. A retention rack as defined in claim 1, wherein said compressible component comprises a spring and wherein said permanent structure comprises two parallel planer surfaces and wherein the distance between said parallel surfaces is less than the height of the rack when said spring is in an uncompressed state.

3. A retention rack as defined in claim 2 wherein said attachment to said permanent structure is effected by positioning said base piece and said top piece between said parallel surfaces and compressing said spring such that said rack is held between said surfaces by an expansion force generated by said spring.

* * * * *